United States Patent [19]

Karino et al.

[11] 4,229,384

[45] Oct. 21, 1980

[54] CARBURETOR WITH STARTING MEANS

[75] Inventors: Kimiji Karino; Masami Nagano; Masakichi Momono, all of Katsuta, Japan

[73] Assignee: Hitachi, Ltd., Japan

[21] Appl. No.: 904,323

[22] Filed: May 9, 1978

[30] Foreign Application Priority Data

May 13, 1977 [JP] Japan ..... 52-54315

[51] Int. Cl.[2] ..... F02M 1/06

[52] U.S. Cl. ..... 261/39 D; 261/121 A

[58] Field of Search ..... 261/39 D, 121 A

[56] References Cited

U.S. PATENT DOCUMENTS

| | | | |
|---|---|---|---|
| 3,059,909 | 10/1962 | Wise | 261/39 D |
| 3,533,386 | 10/1970 | Masaki et al. | 261/DIG. 19 |
| 3,877,448 | 4/1975 | Schmid | 261/39 D |

FOREIGN PATENT DOCUMENTS

| | | | |
|---|---|---|---|
| S 38751 | 6/1956 | Fed. Rep. of Germany | 261/39 D |

*Primary Examiner*—Tim R. Miles

*Attorney, Agent, or Firm*—Craig & Antonelli

[57] ABSTRACT

A carburetor for an internal combustion engine including a main suction conduit having a control throttle and a starting suction conduit having an on-off valve and opening at one end in a portion of the main suction conduit disposed downstream of the control throttle, wherein a main fuel passage and a main air bleed passage having a main air bleed for the main fuel passage are provided for the main suction conduit. A communication passage is provided to communicate a portion of the starting suction conduit disposed upstream of the on-off valve with a portion of the main air bleed passage disposed upstream of the main air bleed. By this arrangement, when the throttle valve is opened to accelerate the engine before it is completely warmed up after being started, the suction pressure from the starting suction conduit is transmitted through the communication passage to the upstream side of the main air bleed passage whereby the fuel-air mixture supplied through the main suction conduit to the engine can be enriched substantially at a uniform rate.

3 Claims, 3 Drawing Figures

CARBURETOR WITH STARTING MEANS

LIST OF PRIOR ART REFERENCES (37CFR 1.56(a))

Japanese Utility Model Publication No. 12822/77 Mar. 23, 1977

BACKGROUND OF THE INVENTION

1. Field of the Invention

This invention relates to carburetors for internal combustion engines and more particularly to improved starting means of a carburetor of the type which includes a starting suction conduit for supplying a fuel-air mixture to the internal combustion engine when the engine is started and warmed up, in addition to a main suction conduit for supplying a fuel-air mixture to the engine after completion of warm-up.

2. Description of the Prior Art

A carburetor having a main suction conduit and a starting suction conduit is known as from Japanese Utility Model Publication No. 12822/77. This type of carburetor generally comprises a main suction conduit, a control throttle mounted in the main suction conduit, a main fuel passage for the main suction conduit, a main air bleed passage for the main fuel passage, a starting suction conduit, a starting fuel passage for feeding a fuel to the starting suction conduit, and a valve mounted in the starting suction conduit. In this type of carburetor, if the degree of opening of the control throttle is increased when the warm-up of the engine is not completed yet after the engine is started, then the suction pressure increases in a portion of the main suction conduit which is disposed downstream of the control throttle where the starting suction conduit opens in the main suction conduit. This causes a reduction in the quantity of a fuel-air mixture supplied through the starting suction conduit, with the result that the fuel-air mixture supplied to the engine becomes lean even if the control throttle is opened to permit the fuel to be supplied through the main fuel passage. Thus the mixture supplied to the engine becomes too lean to operate the engine which is not fully warmed up yet. As a result the problem of cessation of fuel combustion or deterioration of the acceleration ability during operation of the engine is raised.

To cope with this situation, it has hitherto been common practice to use a method wherein the fuel-air ratio is compensated more than is necessary to enrich the fuel-air mixture, so as to thereby increase the range in which the fuel-air mixture can have its proportions of fuel and air compensated in accordance with an increase in the volume of air intake. However, this method has the disadvantages that it is not economical to use this method because fuel consumption increases in the vicinity of the minimum air volume, and that the correction of the fuel-air ratio is not carried out satisfactorily except in the vicinity of the minimum air volume.

SUMMARY OF THE INVENTION

This invention has as its object the provision of a carburetor which is provided with improved starting means which avoids excess leaning of a fuel-air mixture supplied to the engine even if the control throttle in the main suction conduit is opened when the engine is not completely warmed up yet after being started.

According to this invention, the aforementioned object is accomplished by providing a communication passage which communicates a portion of the starting suction conduit which is disposed upstream of the valve in the starting suction conduit with a portion of the main air bleed passage which is disposed upstream of the main air bleed.

By the provision of the aforesaid communication passage, the following effect can be achieved. If the engine is accelerated by opening the control throttle when it is not completely warmed up yet, the volume of air supplied to the engine will increase. In this case, an increase in the suction pressure causes a reduction in the quantity of a fuel-air mixture supplied through the starting suction conduit as aforesaid. However, the suction pressure from the starting suction conduit is transmitted to the portion of the main air bleed passage which is disposed upstream of the main air bleed, with the result that the bleed air is reduced in volume and the fuel-air mixture supplied to the engine through the main suction conduit is enriched substantially at a uniform rate. Thus a fuel-air mixture of a richness suitable for operating the engine when it is not completely warmed up yet is supplied to the engine, thereby enabling the aforesaid disadvantages of the prior art to be obviated.

DETAILED DESCRIPTION OF THE PREFERRED EMBODIMENT

Figure 1:
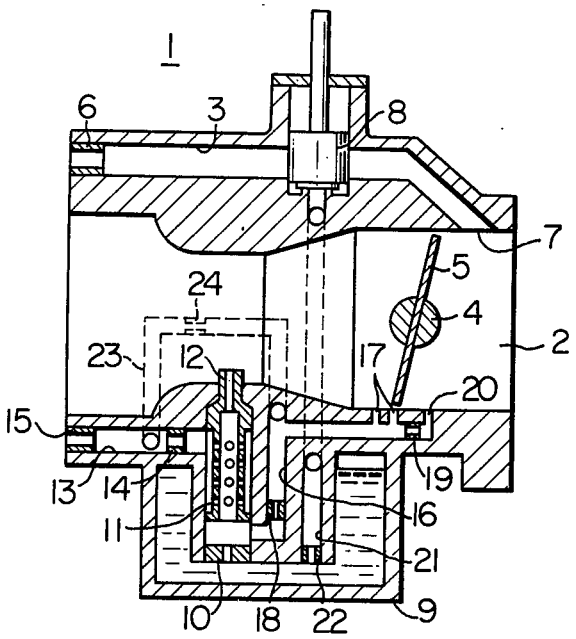
FIG. 1 PRIOR ART
FIG. 1 is a vertical sectional side view of a carburetor of the prior art.

FIG. 1 shows a carburetor of the prior art of the type which includes a main suction conduit and a starting suction conduit.

More specifically, the carburetor generally designated by the numeral 1 comprises the main suction conduit 2 and the starting suction conduit 3. In the main suction conduit 2, a control throttle or throttle valve 5 is supported by a valve shaft 4 for pivotal movement. The starting suction conduit 3 has a starting air jet 6 mounted at its upstream end, and opens at its downstream end in a portion 7 of the main suction conduit 2 which is disposed downstream of the throttle valve 5. A starter valve 8 is mounted midway in the starting suction conduit 3 and the valve is operated in a manner to open the starting suction conduit 3 when the engine is started and warmed up.

A float chamber 9 is attached to one side of the main suction conduit 2 and has mounted therein, through a main fuel jet 10, a mixing cylinder 11 which is provided, at its upper end, with a main nozzle 12 opening in a portion of the main suction conduit 2 which is disposed upstream of the throttle valve 5. The mixing cylinder 11 communicates with a main air bleed passage 13 which has a main air bleed 14 mounted in the vicinity of the mixing cylinder 11, and a pre-main air bleed 15 mounted at the upstream end of the passage 13.

The mixing cylinder 11 is maintained, at its suction side, in communication with one end of a duct 16 for low speed operation, the duct 16 opening at the other end thereof, through bypass ports 17, in a portion of the main suction conduit 2 which is disposed in the vicinity of the throttle valve 5. The bypass ports 17 perform the function of supplying a fuel to the main suction conduit 2 at the time of low speed operation. The duct 16 for low speed operation has a low speed jet 18 mounted at the upstream end portion thereof and an idling jet 19 mounted in the vicinity of the bypass ports 17. An idle port 20 is provided to the duct 16 for idling operation in a position which is disposed downstream of the idle jet 19.

A duct 21 for supplying a fuel when the engine is started is located adjacent the duct 16 for low speed operation and connected, at one end thereof, to the starting suction conduit 3. Normally, communication between the duct 21 and the starting suction conduit 3 is blocked by the starter valve 8. A starter jet 22 is mounted at the other end of the duct 21. A portion of the main air bleed passage 13 which is disposed upstream of the main air bleed 14 communicates with the duct 16 for low speed operation through a duct 23 which mounts a low speed air bleed 24 midway therein.

In the carburetor 1 constructed as aforesaid, control of the quantity of a fuel-air mixture is effected by opening and closing the throttle valve 5. In low speed operation, the fuel metered by the low speed jet 18 disposed downstream of the main jet 10 is supplied to the main suction conduit 2 through the bypass ports 17 and idle port 20. This type of carburetor has a fuel-air ratio characteristic as indicated by a solid line curve A in FIG. 2, when the starting suction conduit 3 is not in operation following completion of the warm-up of the engine.

Meanwhile an engine requires a richer fuel-air mixture when its warm-up is not completed yet after being started than when its warm-up is completed. To meet this requirement, the starter valve 8 mounted in the starting suction conduit 3 is opened to supply an enriched fuel-air mixture to the starting suction conduit 3 so as to bring the richness of the mixture to a level which is required to start and warm-up the engine. The enriched fuel-air mixture supplied in this manner is added to the fuel-air mixture supplied through the main suction conduit 2, so that the fuel-air mixture supplied to the engine will be enriched as a whole to a level which is required for starting and warming up the engine.

However, if the degree of opening of the throttle valve 5 is increased when the warm-up of the engine is not completed yet, then the suction pressure increases and causes a reduction in the pressure differential between the upstream side and the downstream side of the starting suction conduit 3. This results in a reduction in the quantity of fuel-air mixture supplied through the starting suction conduit 3, and consequently the fuel-air mixture supplied to the engine is leaned. Therefore, even if by the increase of the degree of opening of the throttle valve 5 some quantity of fuel-air mixture is supplied through the main nozzle 12, the fuel-air mixture supplied as a whole to the engine is lower in richness than the fuel-air mixture which is required for operating the engine which is not completely warmed up yet. Consequently, the problem that fuel combustion temporarily ceased or the acceleration ability deteriorates is encountered.

Figure 2:
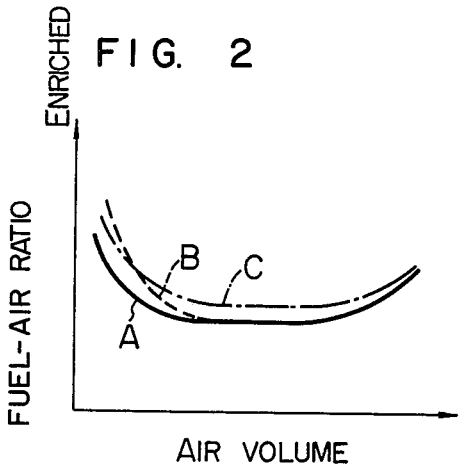
FIG. 2 is a graph showing the relation between the air volume and the fuel-air ratio.

To cope with this situation, it has hitherto been customary to compensate the fuel-air ratio at the minimum air volume more than is necessary, as indicated by a curve B in FIG. 2, to enrich the fuel-air mixture, so as to thereby increase the range in which the fuel-air mixture can be compensated with an increase in the volume of air intake. However, this method is uneconomical because fuel consumption increases in the vicinity of the minimum air volume. Moreover, in a range excepting the minimum air volume, there is the following disadvantage. If the degree of opening of the throttle valve 5 is increased to increase the volume of air intake over and above the range shown in the curve B in FIG. 2 in which the fuel-air mixture can be compensated, the air-fuel ratio characteristic will become similar to that which is obtained, as indicated by the curve A which shows the ratio when the warm-up of the engine is completed. Thus the fuel-air mixture is lower in richness than a fuel-air mixture required for an engine which is not completely warmed up yet, and the problem of insufficient enrichment of the fuel-air mixture in the range of air volume beyond the curve B still remains.

Figure 3:
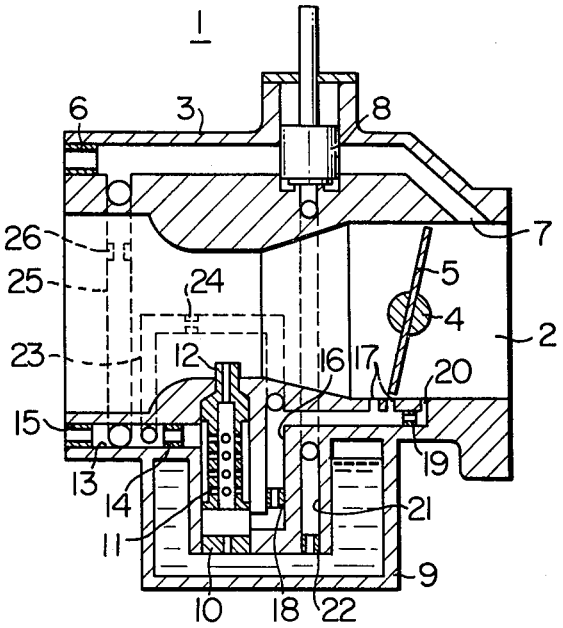
FIG. 3 is a vertical sectional side view of one embodiment of this invention.

FIG. 3 shows a preferred embodiment of the present invention. In FIG. 3, parts similar to those shown in FIG. 1 are designated by like reference characters.

In the embodiment shown, a communication passage 25 is provided to communicate a portion of the main air bleed passage 13 of the fuel system for the main suction conduit 2 which is disposed upstream of the main air bleed 14 and which is also disposed upstream of the low speed air bleed 24 in the duct 23 with a portion of the starting suction conduit 3 which is disposed upstream of the starter valve 8. A balancing jet 26 is mounted midway in the communication passage 25.

In the embodiment of the invention constructed as aforesaid, if the throttle valve 5 is opened and the volume of air intake increases to accelerate the engine when the latter is not completely warmed up yet immediately after being started, the suction pressure from the starting suction conduit 3 is transmitted to portions of the main air bleed passage 13 and the duct 23 which are disposed upstream of the main air bleed 14 and the low speed air bleed 24 respectively, and the pressure differential between the upstream side and the downstream side of each of the air bleeds 14 and 24 is reduced. This reduces the volume of bleed air, so that the fuel-air mixture supplied through the main suction conduit 2 to the engine can be enriched substantially at a uniform rate.

Therefore, even if the throttle valve 5 is brought to a substantially full open position and the volume of air intake is maximized, it is possible to compensate the fuel-air ratio in a fuel-air mixture in such a manner that the mixture is enriched in substantially the entire range of the air volume or throttle opening, as can be seen in a curve C in FIG. 2, which is obtained when the starter valve 8 is opened while the warm-up of the engine is not completed yet. Therefore, the engine can be smoothly accelerated even when the warm-up of the engine is not completed, thereby obviating the aforementioned disadvantages of this type of carburetor of the prior art.

A compensation in the fuel-air ratio in a mixture relative to the volume of air intake can be made as desired by suitably selecting the dimensions of the pre-main air bleed 15, starting air jet 6 and balancing air jet 26.

Accordingly, if the compensation of air-fuel ratio in a mixture is adjusted by using, as a reference, the curve A in FIG. 2 which shows the air-fuel ratio characteristic obtained when the starter valve 8 is closed following completion of the warm-up of the engine, it is possible to obtain an optimum value for the compensation of the fuel-air ratio in a mixture. Thus the fuel can be consumed economically by selecting a suitable fuel-air ratio, and the engine can be operated in a condition which is free from cessation of fuel combustion or deterioration of the acceleration ability.

In the carburetor according to the invention, the fuel-air ratio characteristic shifts from the curve C to the curve A when the starter valve 8 is closed upon completion of the warm-up of the engine.

From the foregoing description, it will be appreciated that according to the present invention, a communication passage is provided in a carburetor of the type which comprises a main suction conduit and a starting suction conduit, to communicate the portion of the main air bleed passage which is disposed upstream of the main air bleed for the main fuel passage of the main suction conduit with the portion of the starting suction conduit which is disposed upstream of the starter valve. By this arrangement, the invention can achieve the excellent effect that, when the starter valve is open while the engine is being warmed up, the negative pressure produced in the starting suction conduit is made to act on the portion of the main air bleed passage which is disposed upstream of the main air bleed for the main fuel system, so that, even if the throttle valve in the main suction conduit is opened, the fuel-air mixture in the main suction conduit will not be leaned excessively as compared with the fuel-air mixture required by the engine which is completely warmed up.

What is claimed is:

1. A carburetor comprising:

a main suction conduit a control throttle mounted in said main suction conduit;

a main fuel passage for said main suction conduit;

a main air bleed passage having a main air bleed for said main fuel passage;

a starting suction conduit;

a starting fuel passage for supplying a fuel to said starting suction conduit; and a valve mounted in said starting suction conduit for controlling intake air;

wherein the improvement comprises:

means for preventing excess leaning of a fuel-air mixture supplied to an engine when said control throttle is opened prior to completion of engine warm-up comprising:

a communication passage provided to communicate a portion of said starting suction conduit which is disposed upstream of said valve with a portion of said main air bleed passage which is disposed upstream of said main air bleed.

2. A carburetor as claimed in claim 1, wherein a balancing jet is mounted midway in said communication passage.

3. A carburetor as claimed in claim 1 or 2, further comprising a low speed fuel passage opening in said main fuel passage, and a low speed air bleed passage connected to said main air bleed passage and provided in said low speed fuel passage, and wherein said communication passage opens at one end thereof in said main air bleed passage in a position which is upstream of a low speed air bleed in said low speed air bleed passage.

* * * * *